United States Patent [19]

Folsom et al.

[11] 4,015,511

[45] Apr. 5, 1977

[54] FEEDER

[75] Inventors: Lawrence R. Folsom, Schenectady, N.Y.; John F. O'Brien, St. Albans, Vt.; Roger E. Gaboriault, Williston, Vt.; August J. Haberstroh, N. Hero, Vt.; Ettore J. Mancuso, Jr., Essex Junction, Vt.

[73] Assignee: General Electric Company, Burlington, Vt.

[22] Filed: Aug. 19, 1974

[21] Appl. No.: 498,353

[52] U.S. Cl. ..... 89/33 SF; 89/33 CA

[51] Int. Cl.[2] ..... F41D 9/02

[58] Field of Search ..... 89/33 R, 33 SF, 33 B, 89/33 BA, 33 BB, 33 BC, 33 C, 33 CA

[56] References Cited

UNITED STATES PATENTS

| | | | |
|---|---|---|---|
| 623,003 | 4/1899 | Garland | 89/33 CA |
| 636,977 | 11/1899 | Garland | 89/33 R |
| 643,118 | 2/1900 | Garland | 89/33 C |
| 1,293,021 | 2/1919 | Browning | 89/33 C |
| 3,417,657 | 12/1968 | Maillard et al. | 89/33 CA |

*Primary Examiner*—Stephen C. Bentley
*Attorney, Agent, or Firm*—Bailin L. Kuch

[57] ABSTRACT

A gun is described having a feeder, for a gun bolt, accomodating two independent trains of ammunition, and having two sets of sprockets and articulated feed arms for positively advancing each round in sequence transversely onto the face of the gun bolt.

27 Claims, 23 Drawing Figures

10
12
14
144
146
154
156
234
240

10

132
242
274
254
278
224
276
19
256
228L
150L
264
222
244
266
19

FEEDER

BACKGROUND OF THE INVENTION

1. Field of the Invention

This invention relates to automatic and semiautomatic guns having a reciprocating bolt to receive rounds of ammunition seriatim.

2. Description of the Prior Art

Conventional single barrel automatic guns do not have positive control of the round as it is fed to the face of the bolt. Conventionally, the gun bolt has a single side extractor hook and pushes a transversely biased round longitudinally along a ramp surface to provide transverse displacement of the round until the round is coaxial with the gun bolt and engaged by the extractor hook. This ramping scheme allows the possibility of the gun bolt "overriding" or "underriding" the round. Conventional, relatively highly reliable feed mechanisms of this type are shown by R. H. Colby in U.S. Pat. No. 3,650,175 issued Mar. 21, 1972 and by J. F. O'Brien in U.S. Pat. No. 3,662,646 issued May 16, 1972. Reference may also be had to U.S. Pat. No. 1,786,207 issued to R. F. Hudson on Dec. 23, 1930, to the various feeders illustrated in "The Machine Gun" by G. M. Chinn, Vol. IV, U.S. Government Printing Office, 1955, to U.S. Pat. No. 3,277,787 issued to H. Brieger on Oct. 11, 1966, to U.S. Pat. No. 3,452,640 issued to B. Maillard on July 1, 1969, to U.S. Pat. No. 3,455,204 issued to E. M. Stoner on July 15, 1969, and U.S. Pat. No. 3,744,371, issued to L. C. McFarland on July 10, 1973.

BRIEF SUMMARY OF THE INVENTION

Accordingly, it is an object of this invention to provide a feeder for a single barrel gun which maintains positive control over each round of ammunition as it is fed to the face of the gun bolt.

It is another object of this invention to provide such a feeder offering instant selection for firing from either of two sources of ammunition.

A feature of this invention is a feeder for a gun bolt having a plurality of transverse round guides, a sprocket, and an articulated feed arm for positively advancing each round transversely from said sprocket, along said guides onto the face of the gun bolt.

Another feature of this invention is the provision of such a feeder for accommodating two independent belts of ammunition and for instantly selecting a round from either belt and providing it directly to the face of the gun bolt.

BRIEF DESCRIPTION OF THE DRAWING

These and other objects, features and advantages will be apparent from the following specification thereof taken in conjunction with the accompanying drawing in which:

FIG. 8 is a longitudinal cross-sectional view in elevation taken along the plane 8—8 of FIG. 7;

FIG. 23 is a perspective view of the left half mid receiver housing.

THE PREFERRED EMBODIMENT

Figures 1, 2B, 9:
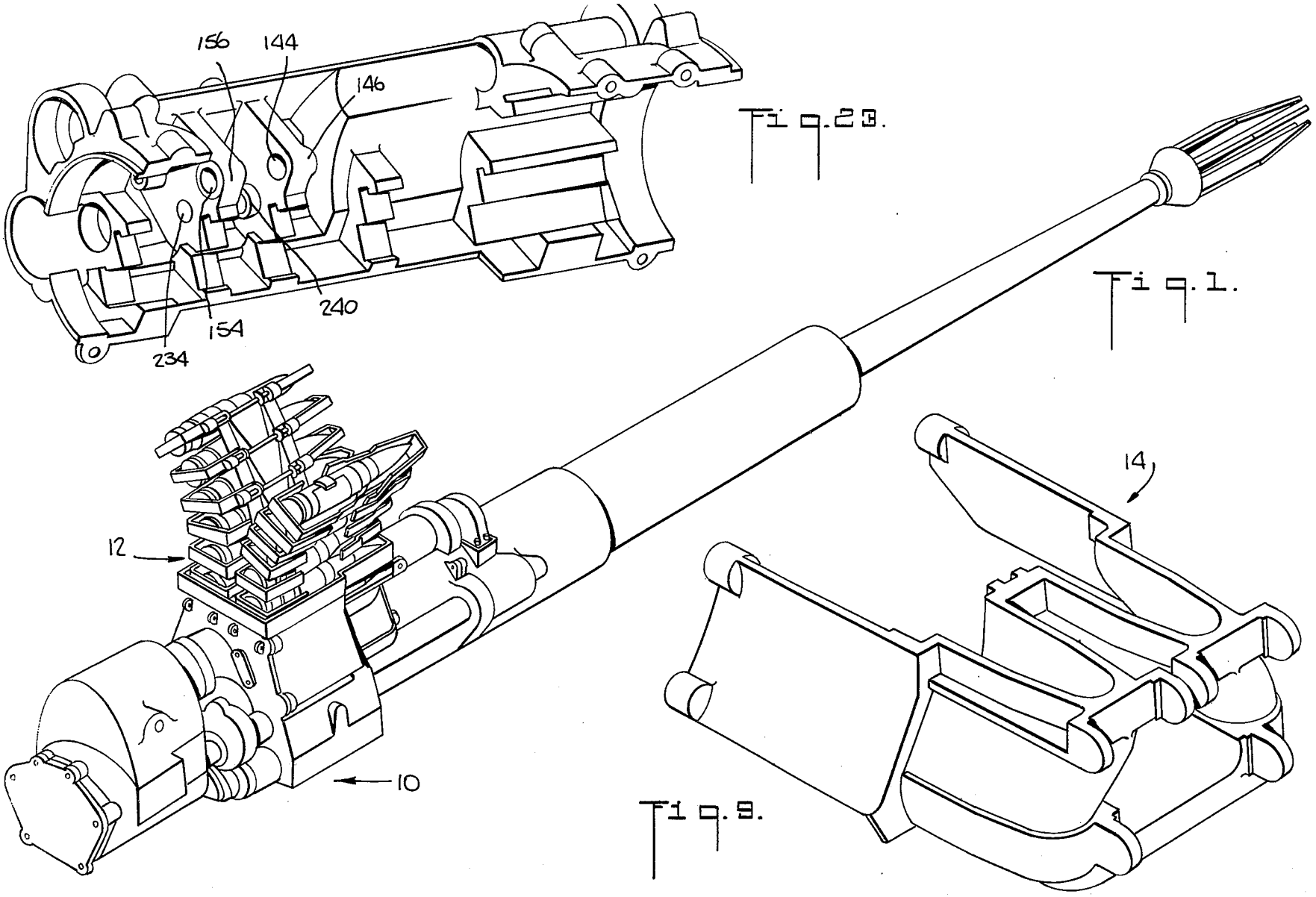
FIG. 1 is a perspective view of a gun embodying this invention.
FIG. 9 is a perspective view of the forward housing of the dual feeder.
Figure 2:
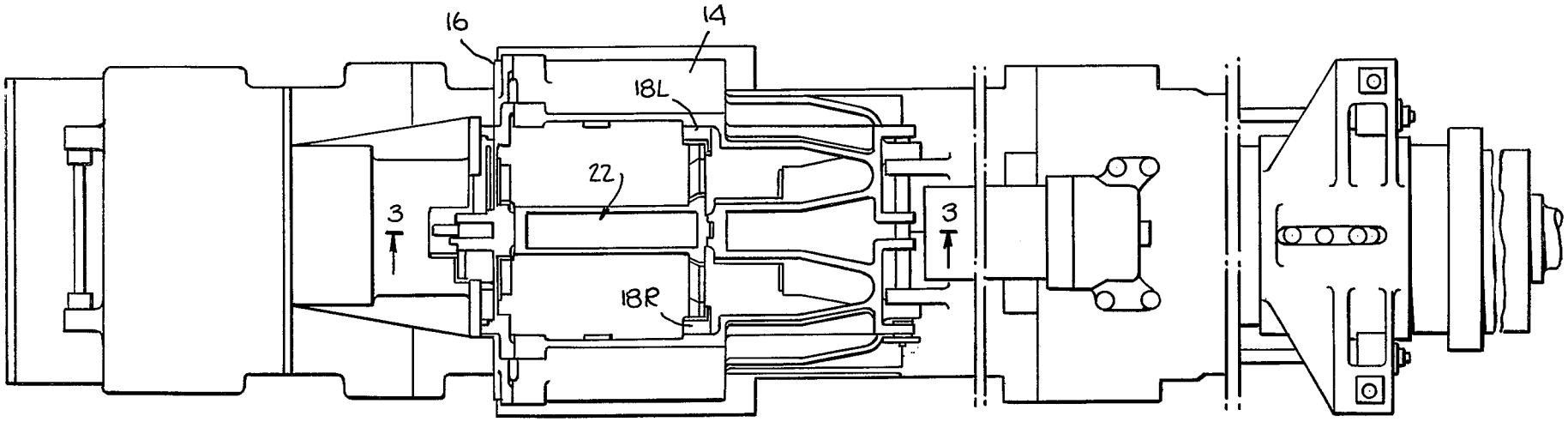
FIG. 2 is a top view of the gun of FIG. 1.
Figure 13:
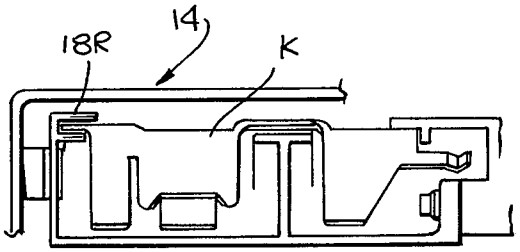
FIG. 13 is a detail view of a stipped link engaged with the right side guide of the dual feeder.
Figure 22:
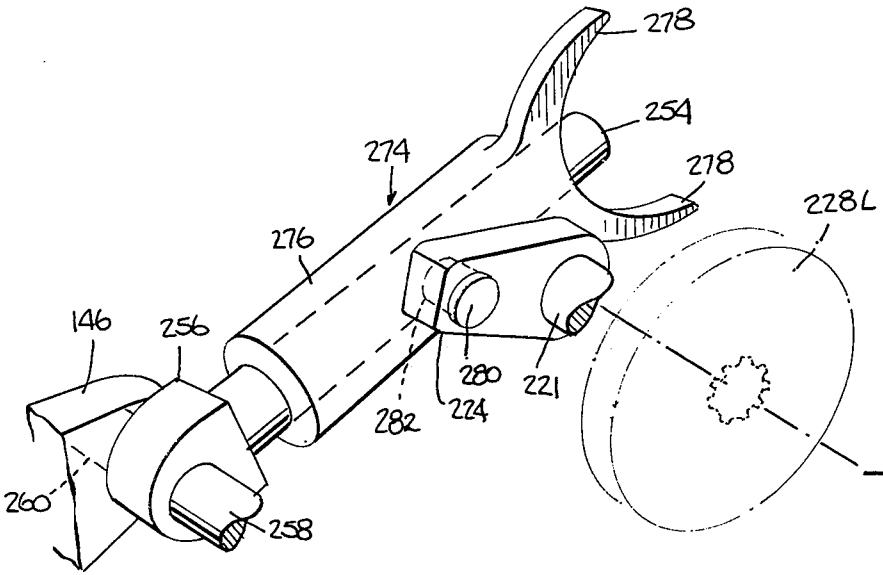
FIG. 22 is a perspective view of the feeder arm of the mid receiver assembly.
Figure 3:
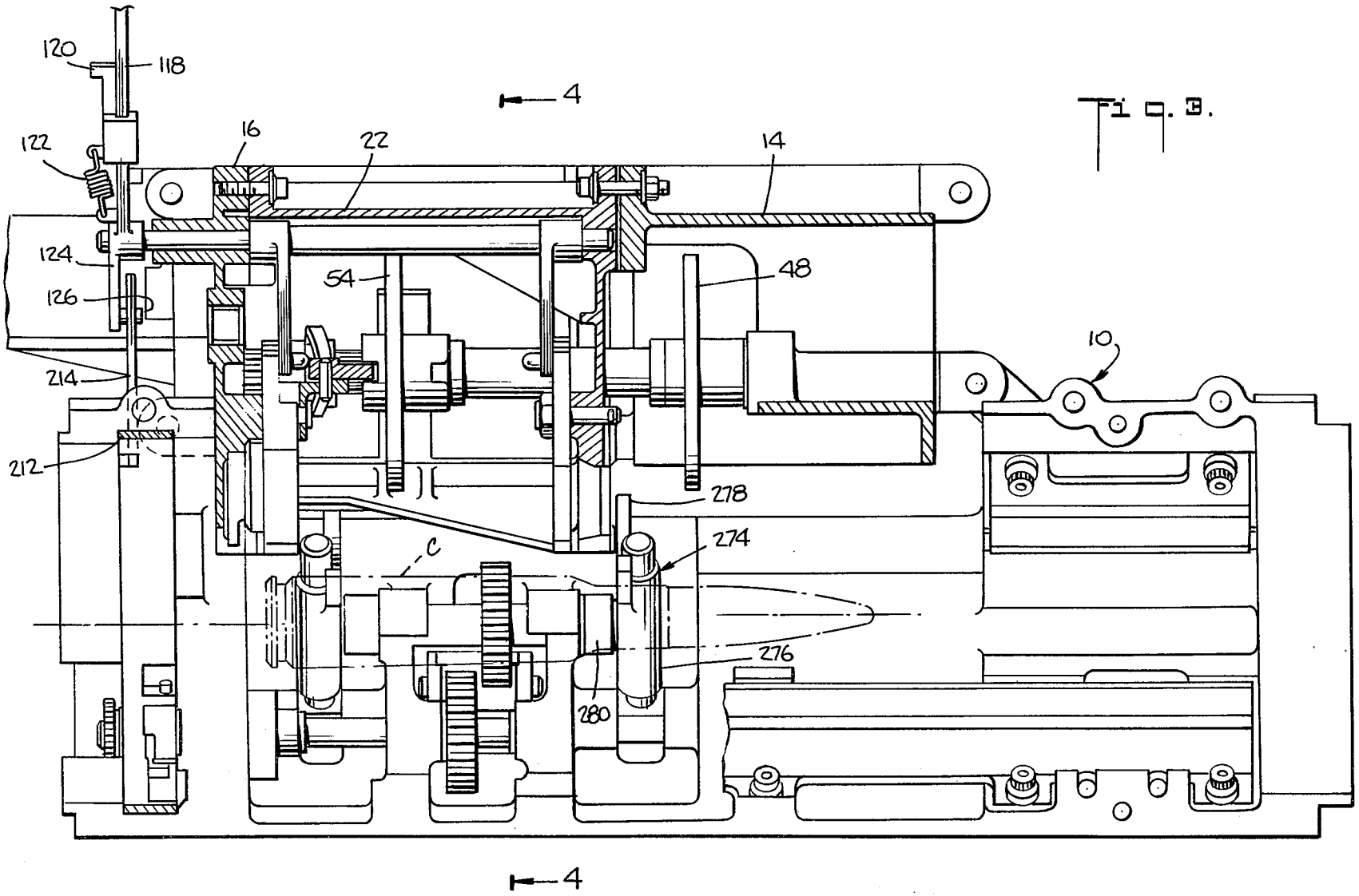
FIG. 3 is a longitudinal cross-sectional view in elevation taken along the plane 3—3 of FIG. 2.
Figure 4:
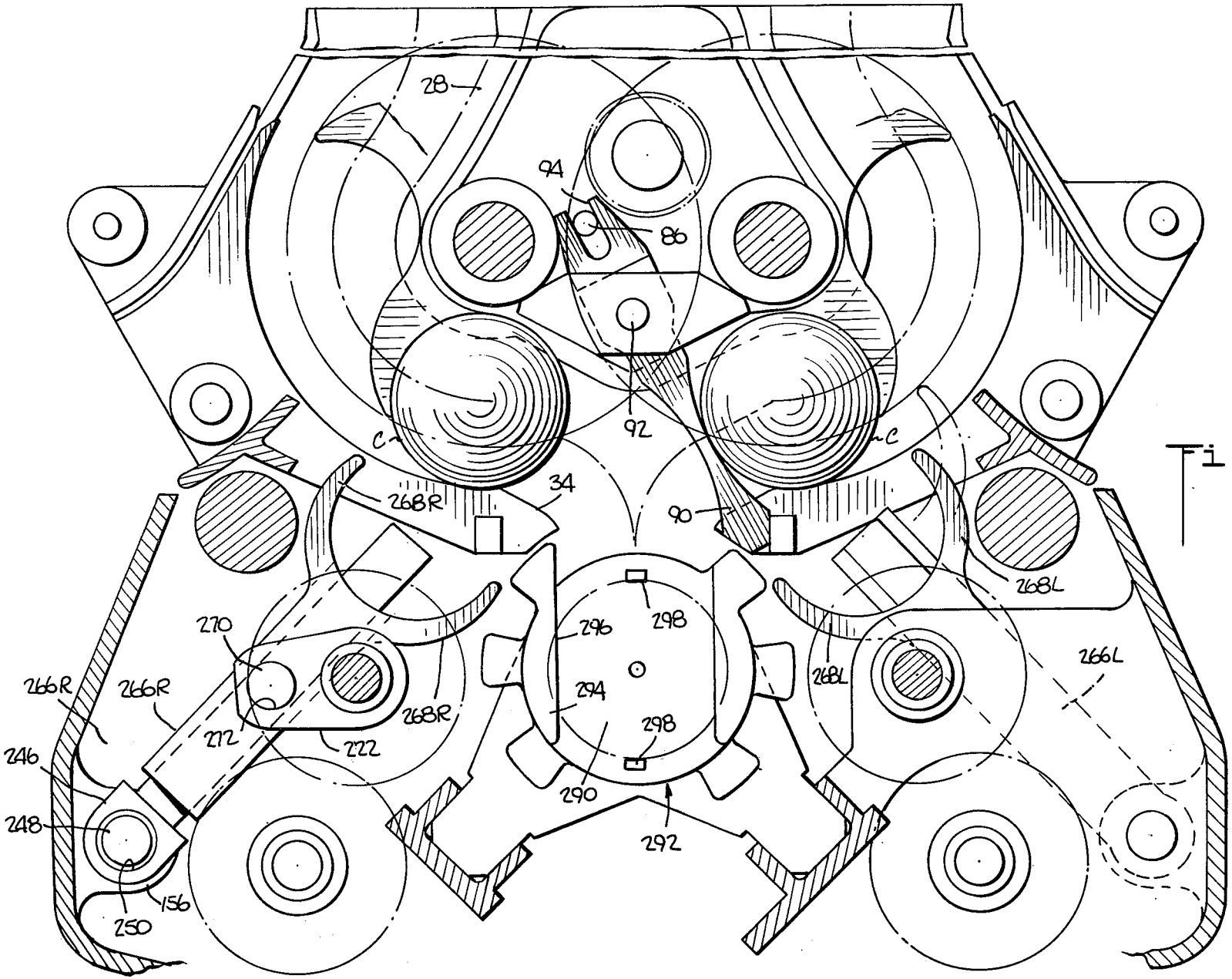
FIG. 4 is a transverse cross-sectional view in elevation (looking aft) taken along the plane 4—4 of FIG. 3.
Figure 5:
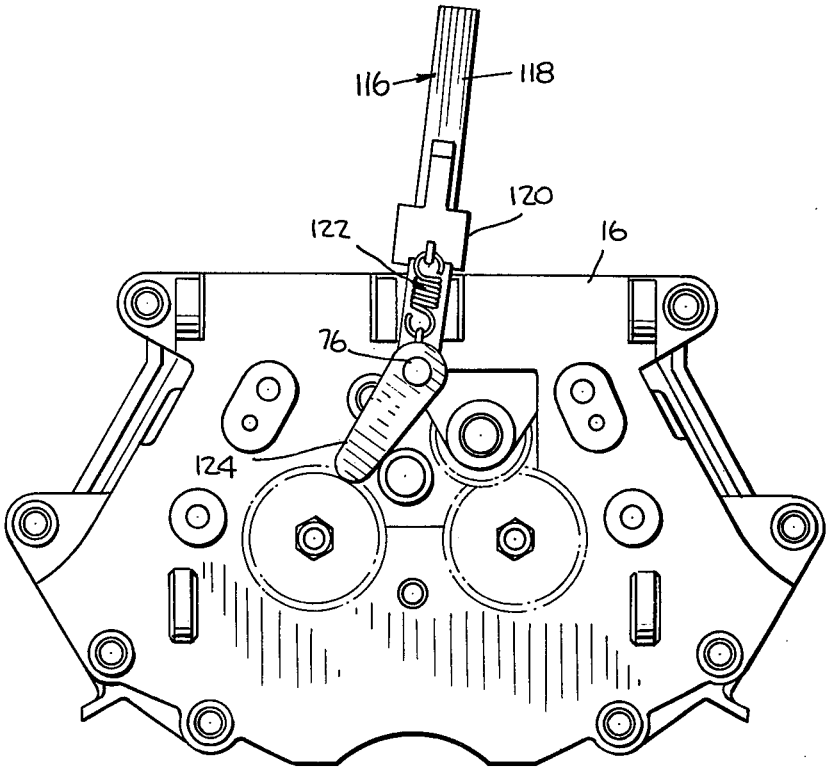
FIG. 5 is an aft end view looking forward of the dual feeder of the gun of FIG. 1.
Figure 6:
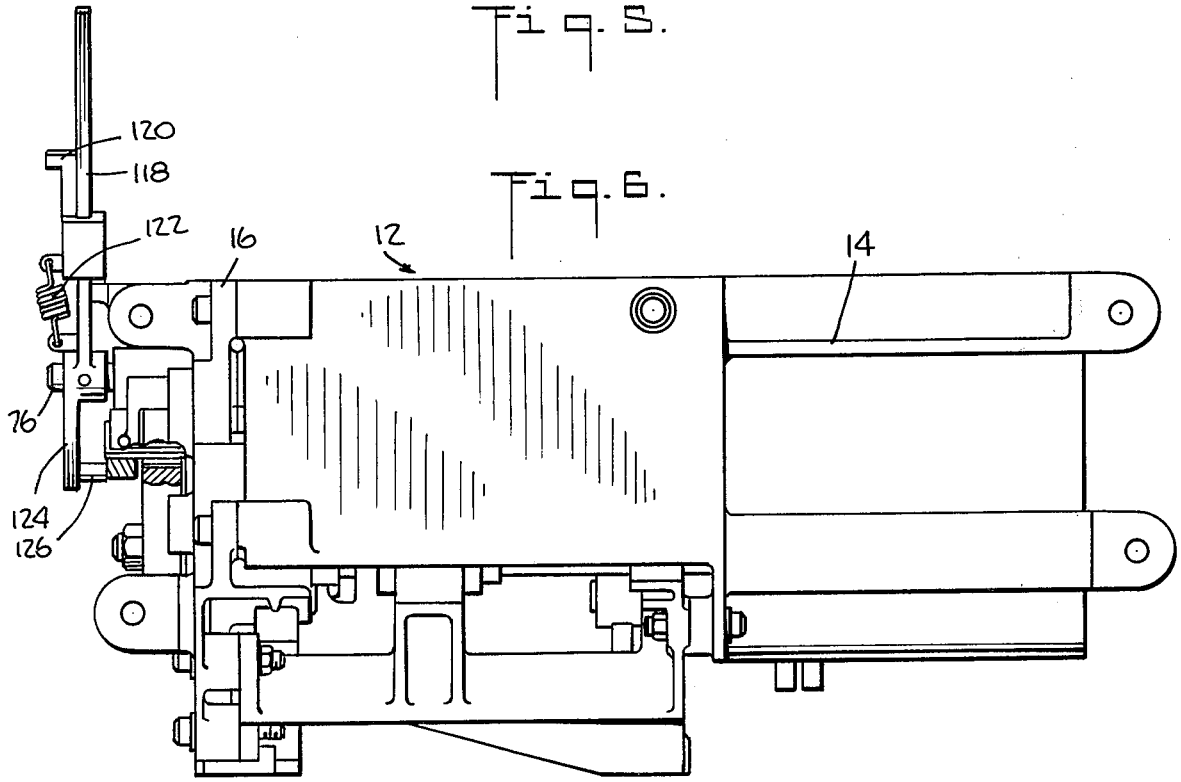
FIG. 6 is a right side view of the dual feeder of FIG. 5.
Figure 7:
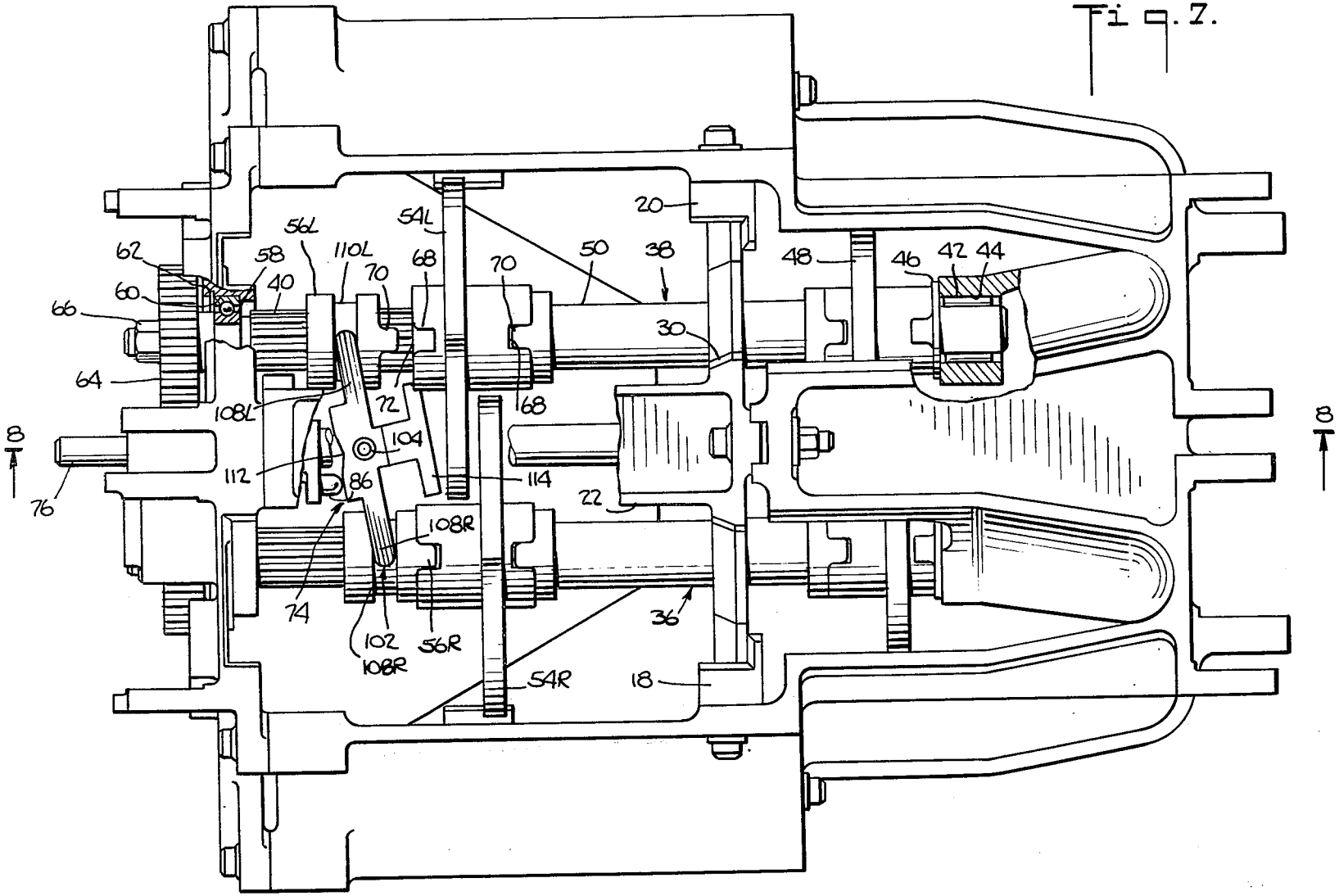
FIG. 7 is a top view of the dual feeder of FIG. 5.
Figure 9:
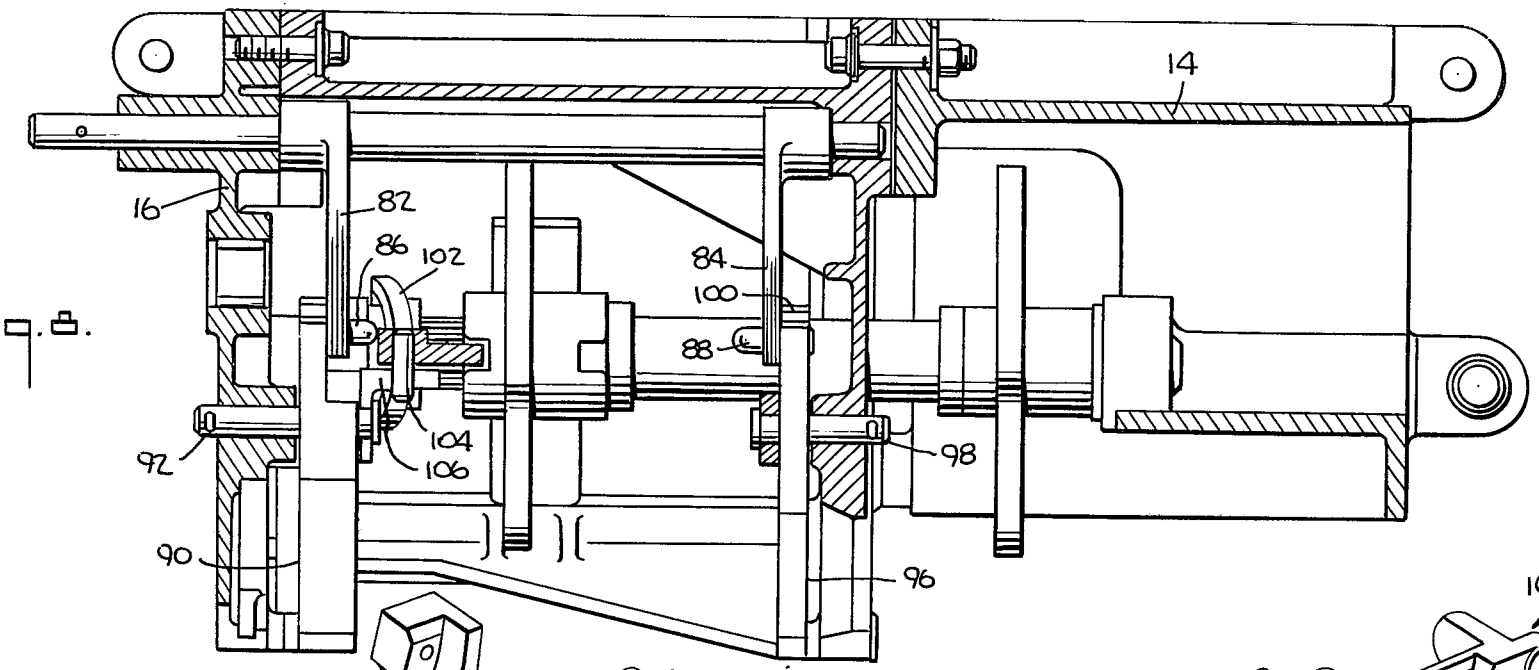
Figure 10:
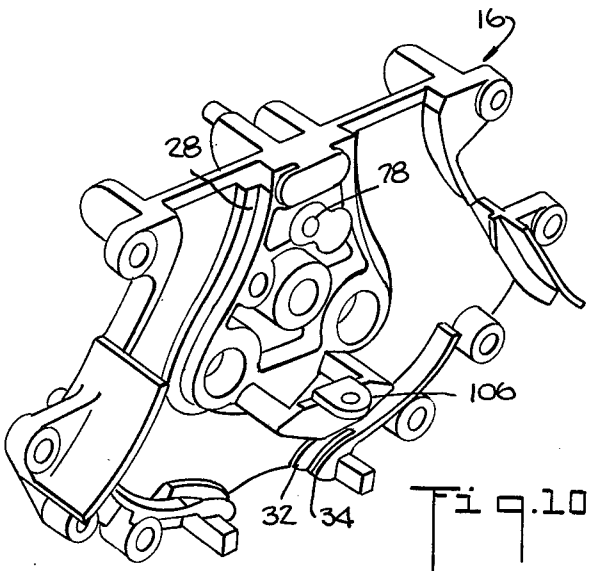
FIG. 10 is a perspective view of the aft housing of the dual feeder.
Figure 11:
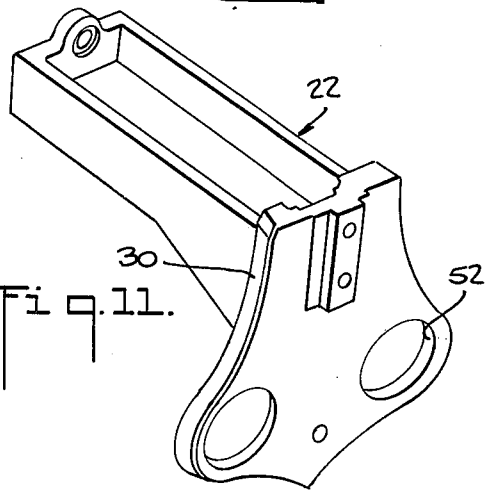
FIG. 11 is a perspective view of the control guide of the dual feeder.
Figure 12:
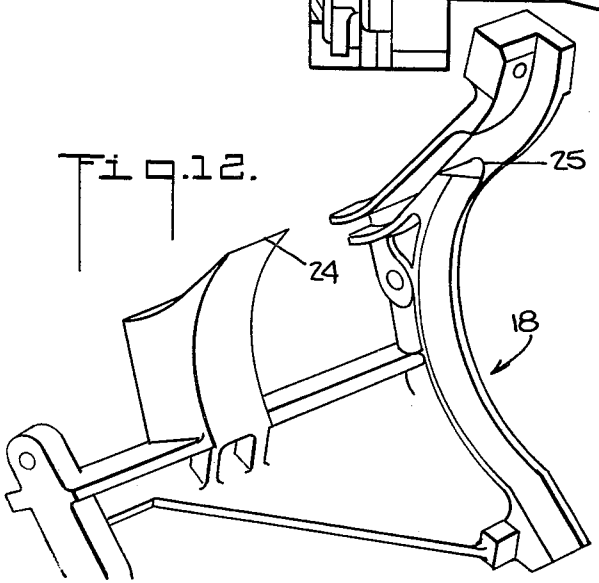
FIG. 12 is a perspective view of the left side guide of the dual feeder.
Figure 14:
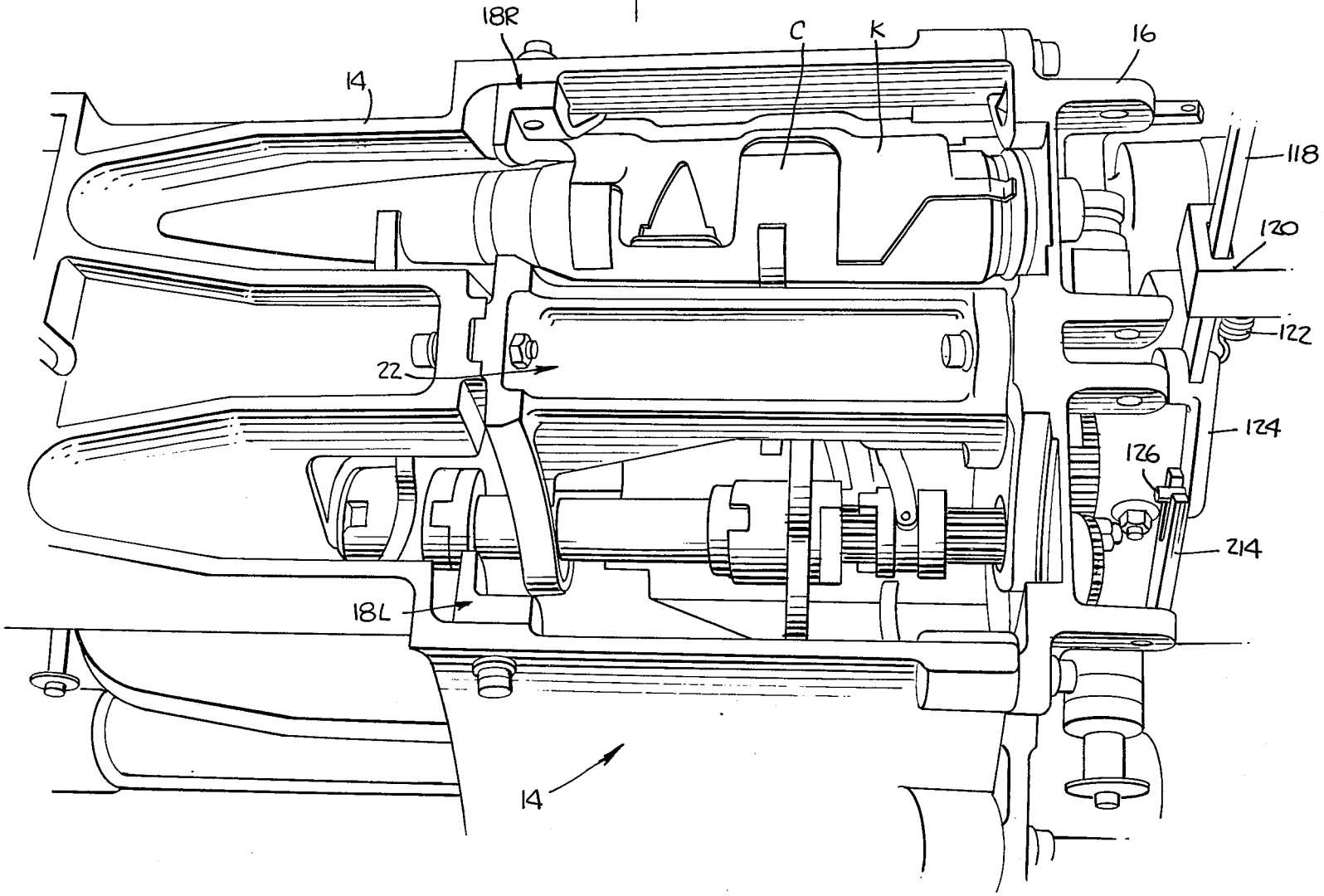
FIG. 14 is a perspective view of the dual feeder showing a linked round in the right in-feed.
Figure 15:
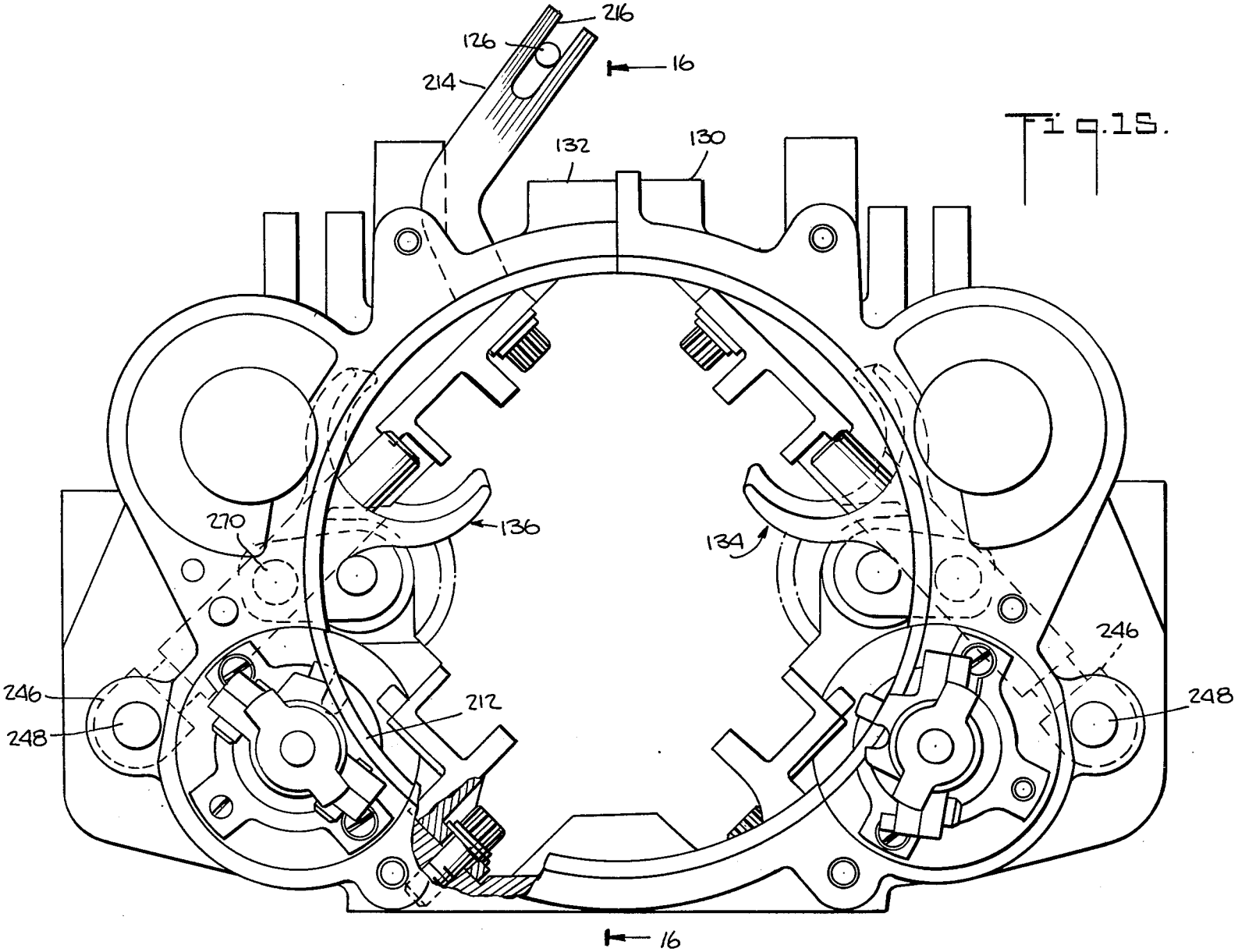
FIG. 15 is a transverse aft end view (looking forward) of the mid receiver assembly.
Figures 16, 17:
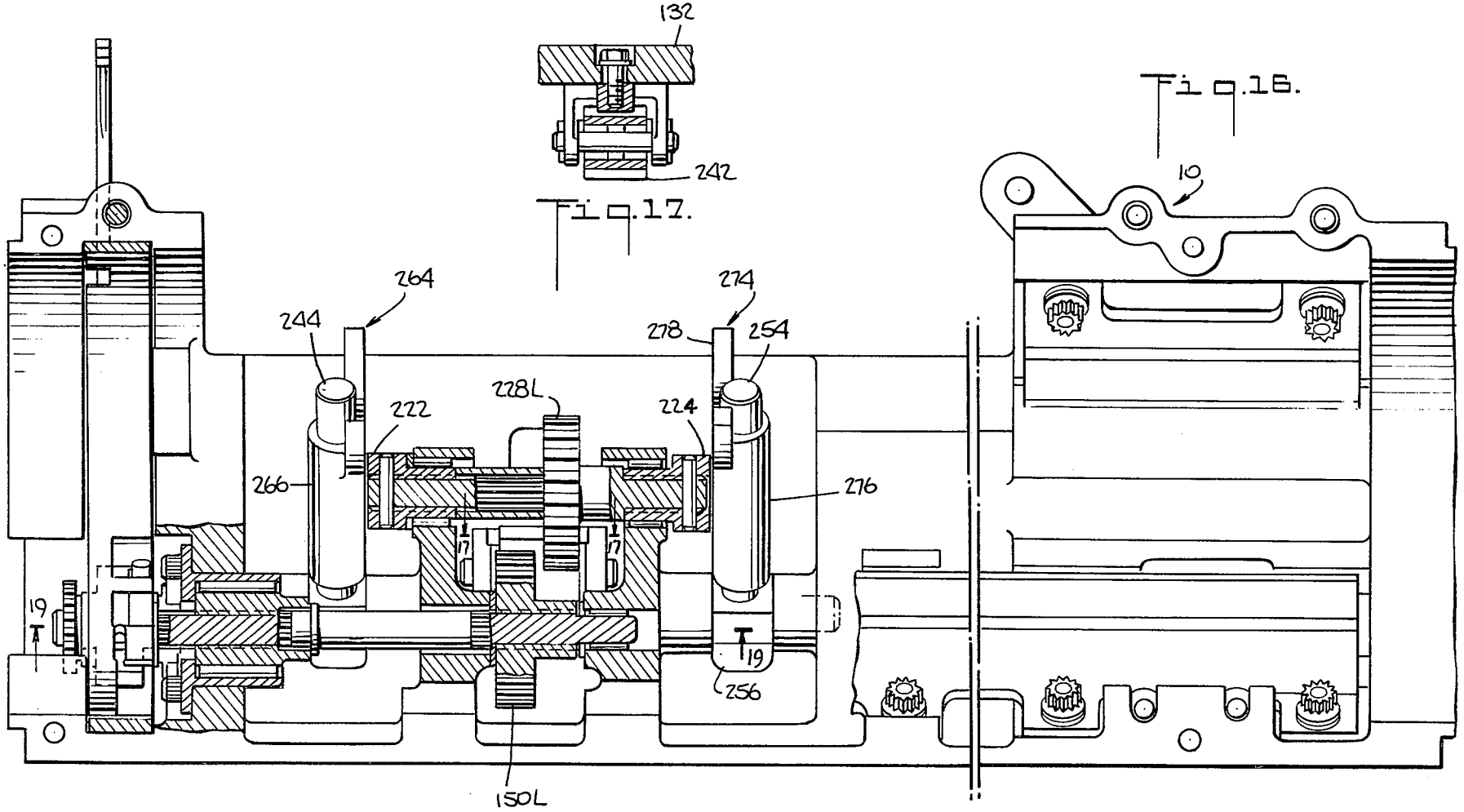
FIG. 16 is a longitudinal cross-section of the mid receiver assembly taken along the plane 16—16 of FIG. 15.
FIG. 17 is a detail cross-section of the idler gear of the mid-receiver taken along plane 17—17 of FIG. 16.
Figure 18:
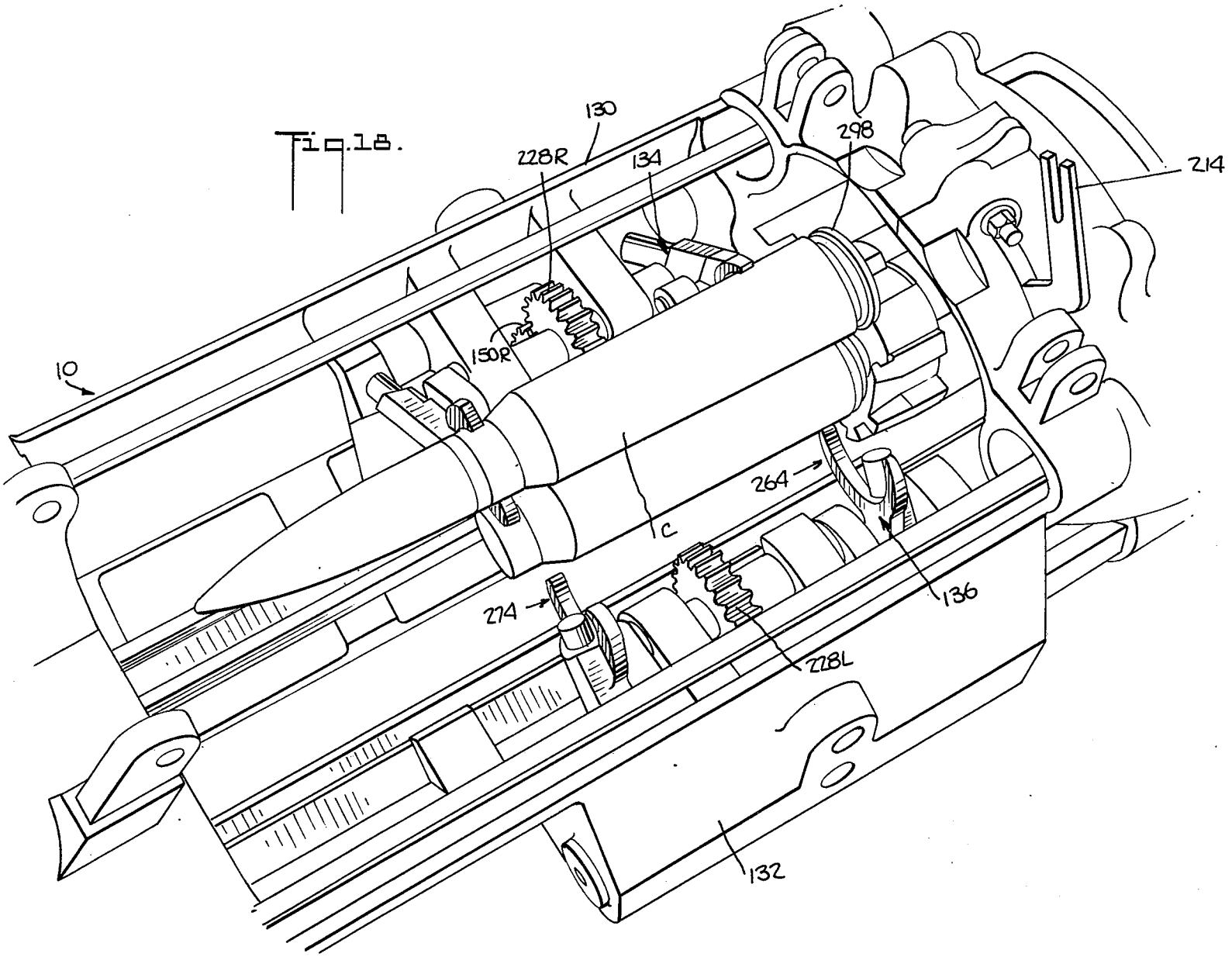
FIG. 18 is a perspective view of the midreceiver showing a stripped round and a fired case in the right in-feed.
Figures 19, 20, 21:
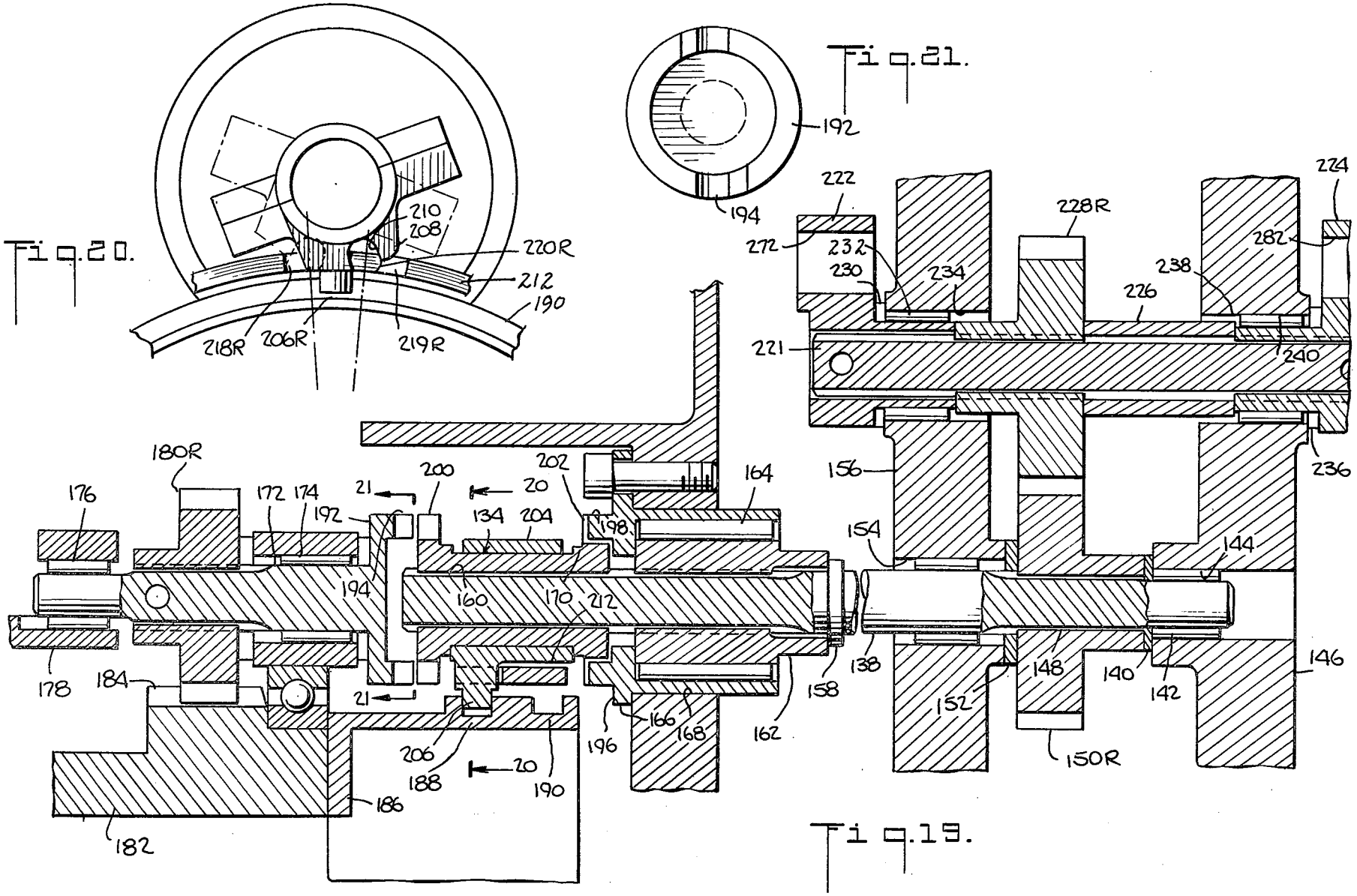
FIG. 19 is a mirror image of detail longitudinal cross-section of the midreceiver taken along the plane 19—19 of FIG. 16, showing the feeder arm and drive connector assemblies.
FIG. 20 is a transverse cross-sectional view of the drive connector taken along the plane 20—20 of FIG. 19.
FIG. 21 is a transverse cross-sectional view taken along the plane 21—21 of FIG. 19.

The feeder herein shown and described is adapted to be used with the machine gun shown and described in Ser. No. 403,121 filed Oct. 3, 1973 by L. R. Folsom, which issued on Oct. 28, 1975 as U.S. Pat. No. 3,915,058, et al in substitution for the feeder therein. Recourse should be made to that disclosure for a complete description of the machine gun. Briefly recapitulating, that machine gun includes a housing in which are journalled for rotation a forward rotor and an aft rotor. A gun barrel is journalled for reciprocation in the housing and carries a cam driver which rides in a track in the forward rotor. A gun bolt is journalled for reciprocation in the housing and has a cam track which receives a cam driver driven by the aft rotor. Recoil of the gun barrel rotates the forward rotor, which is coupled to and rotates the aft rotor, which reciprocates the gun bolt.

The feeder of the present invention is disposed in part without and in part within the main housing of the gun, and comprises the inner or lower midreceiver assembly 10 and the outer or upper feeder assembly 12. The two belts of linked rounds of ammunition are supplied to the feeder assembly through respective chutes. Both the receiver and feeder assemblies are substantially symmetrical about the vertical central plane. The feeder assembly strips the leading round from its link and hands it to the receiver assembly which places it into the face of the gun bolt. Only the right side or the left side of the feeder and receiver assemblies is driven and functions during any gun cycle, but the drive may be switched between gun cycles to instantly switch the source of the rounds to be fired.

The feeder assembly 12 includes a housing made up of a forward housing 14, an aft housing 16, a right side guide 18, a left side guide 20, and a central guide 22, all bolted together. Each of the right and left side guides has a middle stripper hook 24 and a forward stripper hook 25 each having a leading end which enters between the case C of the leading round of ammunition and its link K and which progressively pries the link from the case outwardly of the hook as the round is advanced past the hook inwardly of the hook. A right hand and a left hand stripper sprocket shaft assembly 36 and 38 are respectively journalled between the forward and aft housings. Longitudinal movement of the cartridge case in constrained by an aft inboard guide surface 28 on the aft housing 16 on which the base of the case of the round rides, and a forward guide surface 30 on the central guide 22 on which the neck of the case rides. An aft outboard guide surface 32 with a longitudinally spaced away lip 34 is also provided on the aft housing at the lower portion of the path of the round approaching the bolt. The lip 34 is adapted to enter the extractor groove of the case of the round. Each stripper sprocket shaft assembly includes a stripper shaft 40 which is externally splined adjacent its aft end, and onto which are journalled a forward needle bearing 42, which is fixed into a respective bore 44 in the forward housing, a thrust bearing 46, a forward stripper sprocket 48, a spacer tube 50 which passes through a respective bore 52 in the central guide 22, an aft stripper sprocket 54, an internally splined sleeve 56, a ball bearing 58 which is retained in a respective stepped bore 60 in the aft housing 16 by a retaining ring 62, an internally splined spur gear 64 and a locking nut 66. The stripper sprockets each have a plurality of notches 68 in each of their flange ends, equal to the number of sprocket teeth, to accurately align and permit torque transmission within the sprocket assembly. The number of sprocket teeth and notches here shown is four. The spacer tube 50 and the forward end of the splined sleeve 56 have a like plurality of projections 70 to mate with the notches. The aft sprocket 54 rides against a step 72 in the shaft to longitudinally align it thereto while permitting rotation of the sprockets thereon. The gear 64 and the sleeve 56 are splined to the shaft 40 while the sprockets 54 and 48 and the spacer tube are free on the shaft. When the sleeve 56 is moved forward so that its projections nest in the notches of the sprocket 54, the gear 64 rotates the sprockets via the shaft and the sleeve. When the sleeve 56 is moved aft so that its projections are free of the notches of the sprocket, the sprockets are stationary. It may be noted that the lengths of the fore and aft flanges of the sprockets of the right hand stripper sprocket assembly are the reverse of the left hand assembly, to permit interleaving of the adjacent aft sprockets and adjacent forward sprockets. Each of the gears 64 is meshed with a planetary gear reduction system (not shown) which is driven by the aft rotor gear 184 (described below).

A feed source selector assembly 74 serves to actuate one or the other sides of the feeder and receiver assemblies. The feed source selector assembly includes an actuator shaft 76 which is journalled through a bore 78 in the aft housing 16. An actuator aft arm 82 and an actuator forward arm 84 are fixed to and depend from the shaft. A cam pin 86 is fixed through the distal end of the arm 82, and a cam pin 88 is similarly fixed through the arm 84. An aft gate 90 is pivoted on a pin 92 secured to the aft housing 16, and has a bifurcation 94 in its upper end which receives the aft end of the aft cam pin 86. A forward gate 96 is pivoted on a pin 98 secured to the central guide 22, and has a bifurcation 100 in its upper end which receives the forward end of the forward cam pin 88. An actuator yoke 102 is pivoted on a pin 104 fixed to an ear 106 which extends forwardly from the aft housing 16. The yoke has a right pair of arms 108R which enter into and straddle an annular groove 110R in the right splined sleeve 56R, and a left pair of arms 108L which enter into and straddle an annular groove 110L in the left splined sleeve 56L. The aft face of the body of the actuator yoke has a shallow V-notch 112 therein which is abutted by the forward end of the cam pin 86. When the actuator shaft is rotated counterclockwise, the distal ends of the arms 82 and 84 are swung to the right, swinging the lower ends of the gates 90 and 96 to the left. Also, as the cam pin 86 rides to the right along the right ramp of the V-notch 112 it pivots the right arms 108R of the yoke 102 forwardly, carrying the right splined sleeve 56R forwardly into engagement with the flange of the right aft sprocket 54R, and it pivots the left arms 108L aftwardly, carrying the left splined sleeve 56L aftwardly out of engagement from the left aft sprocket 54L. A T-bar 114 also extends forwardly from the body of the yoke. When the right arms 108R are pivoted forwardly, the left arm of the T-bar is swung to the left and engages an adjacent one of the notches 68 on the left aft sprocket, precluding idle rotation of the left sprockets. A shifting handle 116 is pinned to the shaft 76. The handle includes an upper arm 118 on which is journalled a locking slide 120 which is biased towards its lower, locking position by a helical extension spring 122 secured between the slide and the handle. The handle also includes a lower arm 124 which has a pin 126.

The midreceiver assembly 10 includes a right half receiver housing 130 and a left half receiver housing 132 which are bolted together. A right hand feed arm assembly 134 and a left hand feed arm assembly 136 are respectively disposed in the right and left half receiver housings. Each feed arm assembly includes a drive shaft 138 which has a forward stepped end which is journalled in a thrust bearing 140 and a needle bearing 142 which is fixed in a bore 144 in a forward arm 146 extending inwardly from the housing, a forward splined portion 148 which carries a spur gear 150 and a thrust bearing 152. The shaft also passes through a bore 154 in an aft arm 156 extending inwardly from the housing, has a shoulder 158, and an aft splined end 160. A clutch sleeve 162 is fixed on the splined shaft and is journalled in a one way clutch 164 which is fixed in a bearing stationary support 166 which is disposed through a bore 168 in the aft wall of the receiver and is bolted thereto. An internally splined, tubular drive connector 170 is carried on the aft end of the splined shaft. An intermediate shaft 172 is journalled by fore and aft needle bearings 174 and 176 to the aft receiver housing 178. The shaft is stepped and has an intermediate splined portion which carries a spur gear 180. The aft rotor 182 is journalled within the aft receiver housing and has an annular gear 184 which is meshed with the spur gears 180R and 180L of the right and left hand feed arm assemblies 134 and 136, respectively. An annular cam plate 186 having an annular right hand cam track 188 and an annular left hand cam track 190 is bolted to and coaxial with the aft rotor. The forward end of the shaft 172 terminates in a disk 192 having two diametrically opposed recesses with respective ramp lead-ins 194. The aft end of the stationary bearing support similarly terminates in a disk 196 having two diametrically opposed recesses with respective ramp lead-ins 198. The drive connector 170 has at its aft end a pair of longitudinally extending projections 200 adapted to engage with the recesses 194 and at its forward end a pair of longitudinally extending projections 202 adapted to engage with the recesses 200. A carrier 204 encircles the drive connector 170 and has a depending cam follower pin 206 and a depending projection 208 defining a notch 210 therebetween. A switching ring 212 is disposed concentrically with the annular cam plate 186 and has an arm 214 extending outwardly therefrom which terminates in a clevis 216 which receives the pin 126 of the shifting handle 116. The switching ring has two right hand cutouts 218R and 219R, and a cross-piece 220R to respectively pass the cam follower pin 206R and projection 208R and enter the notch 210R of the right hand carrier 204K and, similarly, two left hand cutouts and a cross-piece. When the arm 214 and the ring 212 are shifted clockwise, the right hand carrier 204R is tilted about the right hand driver connector 170R so that its cam follower pin 206R is disposed entirely through the cutout 218R and into the right hand cam track 188 of the cam plate 186, while the left hand carrier is so tilted about the left hand driver connector that its cam follower pin is tilted out of the left hand cam track 190. When the ring 212 is shifted clockwise, the positions are reversed with the left hand cam follower pin disposed in the left hand cam track 190. The cam tracks 188 and 190 each have a path which for 270° is in a relatively forward transverse plane, and for 90° is in a relatively aftward transverse plane. Thus, when a cam follower pin is disposed in its cam track, the associated carrier 204 and drive connector 170 are shifted forward for 270° of each gun cycle, and are shifted aftward for 90° of each gun cycle. When the connector 170 is forward, its projections 202 are engaged with the projections 198 of the support 166 and the connector is locked against rotation, together with the splined thereto feeder arm drive shaft 138. When the connector is aft, its projections 200 are engaged with the projections 194 of the intermediate shaft 172 and the connector rotates therewith, together with the splined thereto feeder arm drive shaft.

A splined shaft 221 has an aft crank arm 222 and a forward crank arm 224 fixed to its two ends a spacer tube 226 and a spur gear 228 fixed therebetween. The aft crank arm has a thrust washer 230 and a needle bearing 232 which is journalled through a bore 234 in the aft arm 156. The forward crank arm has a thrust washer 236 and a needle bearing 238 which is journalled through a bore 240 in the forward arm 146. In the right hand feed arm assembly the gears 228R and 150R mesh directly, in the left assembly, the gears 228L and 150L mesh with an idler gear 242 which is journalled from the side wall of the left midreceiver housing. An aft arm supporting rod 244 terminates in a lower head 246 which is pivoted by a pin 248 through a bore 250 in the aft arm 156 extending inwardly from the midreceiver housing wall. A forward arm supporting rod 254 terminates in a lower head 256 which is pivoted by a pin 258 through a bore 260 in the forward arm 146 extending inwardly from the midreceiver housing wall. An aft feed arm 264 includes a tube 266 which slides on the rod 244, has a pair of spaced apart arms 268 adapted to receive the case body of a round of ammunition therebetween, and is mediately pivoted by an integral stud 270 through bore 272 in the distal end of the aft crank arm 222. A forward feed arm 274 includes a tube 276, which slides on the rod 264, has a pair of spaced apart arms 278 adapted to receive the projectile of a round of ammunition therebetween, and is mediately pivoted by an integral stud 280 through a bore 282 in the distal end of the forward crank arm 224. Thus each revolution of the drive shaft 138, which occurs once during 90° of the gun cycle, via the shaft 221 and the crank arms 222 and 224, provides a full cycle of reciprocation of the feed arms on their respective rods, and a full cycle of oscillation of the respective rods on their respective pivots. The compound result of which reciprocations and oscillations is to provide a path of travel of the arms which during the feed stroke overlies the path of travel of the rounds from the stripper sprockets to the face of the gun bolt.

As described in Ser. No. 403,121, supra, the face 290 of the gun bolt 292 has a pair of spaced apart extractor lugs 294 having respective lips 296 which enter into the extractor groove of the cartridge case C and which define a channel to receive and pass the extractor disk of the cartridge case. During the interval that the right or left feed arms transfer a round of ammunition to the bolt face, the bolt is in its aft dwell with the face of the bolt in transverse alignment with the guide surfaces 28 and 32. Thus the entire movement of the round during the stripping and feeding operation is transverse, without any longitudinal displacement. The arms 278 and 268 of the feed arms 274 and 264 engage the round while the round is still under the positive control of the stripper sprockets and carry the round along its path past the gates 90 and 96 onto the face of the gun bolt with the lips 296 entering the extractor groove of the case. As the round is progressively carried down across the bolt face the feed arms progressively withdraw from the round, so that when the round is centered on the bolt face, the arms are clear of the round. Also as the arms are feeding the present round to and across the bolt face, the aft lower arm is pushing the previously extracted case downwardly across and off the bolt face. When the round is centered on the bolt face, as described in Ser. No. 403,121, supra, the bolt head is rotated to extend two pins 298 forwardly from the bolt face to capture the round to the bolt face.

What is claimed is:

1. An at least partly self acting gun having a single gun barrel and a single gun bolt and undergoing repeated cycles of operation and firing linked rounds of ammunition comprising:

a housing;

said gun bolt having a bolt face and disposed in said housing and reciprocable along a longitudinal axis to and between a seared station and a chambered station;

said bolt face including a pair of diametrically opposed extractor hooks defining a passageway therebetween for passing the extractor disk of the case of a round of ammunition;

first transfer means disposed in said housing for receiving a first train of linked rounds and for side stripping the leading round from its link in the train;

second transfer means disposed in said housing for receiving a second train of linked rounds and for side stripping the leading round from its link in the train;

third transfer means disposed in said housing for transferring the stripped leading round from said first transfer means to said bolt face when said bolt is at its seared station;

fourth transfer means disposed in said housing or transferring the stripped leading round from said second transfer means to said bolt face when said bolt is at the seared station; and drive means having a first disposition for driving said first and third transfer means and for locking said second and fourth transfer means, and a second disposition for driving said second and fourth transfer means and for locking said first and third transfer means;

said third and fourth transfer means respectively disposing the extractor disk of the case of a transferred round of ammunition into said passageway defined by said extractor hooks, with said hooks entering the extractor groove of that case.

2. A gun according to claim 1 wherein:

said third and fourth transfer means respectively eject the extractor disk of the case of a round from said passageway during the cycle of the gun next subsequent to the cycle during which that round was transferred to said bolt face.

3. And at least partly self acting gun having repeated cycles of operation and firing linked rounds of ammunition comprising:

a housing;

a bolt having a bolt face and disposed in said housing and reciprocable along a longitudinal axis to and between a seared station and a chambered station;

said bolt face including a pair of diametrically opposed extractor hooks defining a passageway therebetween for passing the extractor disk of the case of a round of ammunition;

first transfer means disposed in said housing for receiving a first train of linked rounds and for side stripping the leading round from its link in the train;

second transfer means disposed in said housing for receiving a second train of linked rounds and for side stripping the leading round from its link in the train;

third transfer means disposed in said housing for transferring the stripped leading round from said first transfer means to said bolt face when said bolt is at its seared station;

fourth transfer means disposed in said housing for transferring the stripped leading round from said second transfer means to said bolt face when said bolt is at the seared station; and drive means having a first disposition for driving said first and third transfer means and for locking said second and fourth transfer means, and a second disposition for driving said second and fourth transfer means and for locking said first and third transfer means;

said third and fourth transfer means respectively disposing the extractor disk of the case of a transferred round of ammunition into said passageway defined by said extractor hooks, with said hooks entering the extractor groove of that case.

said third and fourth transfer means respectively including;

first guide means pivoted to said housing for movement in a plane transverse to said longitudinal axis of said gun bolt;

second guide means carried by and journalled for reciprocation along said first guide means and having a pair of spaced apart arms defining a recess for receiving a round of ammunition; and crank means pivoted to said second guide means for reciprocating said second guide means upon said first guide means and thereby causing said first guide means to reciprocate upon its pivot.

4. A gun according to claim 3 wherein:

said drive means includes:

first power transfer means for driving said first transfer means throughout each gun cycle, and third power transfer means for driving said third transfer means for a lesser interval during each gun cycle.

5. A gun according to claim 3 wherein:

said drive means includes:

second power transfer means for driving said second transfer means through each gun cycle, and fourth power transfer means for driving said fourth transfer means for a lesser interval during each gun cycle.

6. An at least partly self acting gun having a single gun barrel and a single gun bolt and undergoing repeated cycles of operation and firing a train of rounds of ammunition comprising:

a housing;

said gun bolt having a bolt face and disposed in said housing and reciprocable along a longitudinal axis to and between a seared station and a chambered station;

said bolt face including a pair of diametrically opposed extractor hooks defining a passageway therebetween for passing the extractor disk of the case of a round of ammunition;

first transfer means disposed in said housing for receiving a first train of rounds and for withdrawing the leading round from its train;

second transfer means disposed in said housing for receiving a second train of rounds and for withdrawing the leading round from its train;

third transfer means disposed in said housing for transferring the withdrawn leading round from said transfer means to said bolt face when said bolt is at its seared station;

fourth transfer means disposed in said housing for transferring the withdrawn leading round from said second transfer means to said bolt face when said bolt is at the seared station; and drive means having a first disposition for driving said first and third transfer means and for locking said second and fourth transfer means, and a second disposition for driving said second and fourth transfer means and for locking said first and third transfer means;

said third and fourth transfer means respectively disposing the extractor disk of the case of a transferred round of ammunition into said passageway defined by said extractor hooks, with said hooks entering the extractor groove of that case.

7. A gun according to claim 6 wherein:

said third and fourth transfer means respectively eject the extractor disk of the case of a round from said passageway during the cycle of the gun next subsequent to the cycle during which that round was transferred to said bolt face.

8. An at least partly self acting gun having a repeated cycle of operation, comprising:

a housing;

a bolt having a bolt face and disposed in said housing and reciprocable along a longitudinal axis to and between a seared station and a chambered station;

first transfer means disposed in said housing for receiving a train of rounds at a substantially uniform linear velocity;

second transfer means disposed in said housing for transferring the leading round from said first transfer means to said bolt face when said bolt is at its seared station;

said second transfer means including:

first guide means pivoted to said housing for movement in a plane transverse to said longitudinal axis of said gun bolt, second guide means carried by and journalled for reciprocation along said first guide means and having a pair of spread apart arms defining a recess for receiving a round of ammunition, and crank means pivoted to said second guide means for reciprocating said second guide means upon said first guide means and thereby causing said first guide means to reciprocate upon its pivot.

9. A gun according to claim 8 wherein:

said bolt face includes a pair of diametrically opposed extractor hooks defining a passageway therebetween for passing the extractor disk of the case of a round of ammunition.

10. A gun according to claim 9 wherein:

said second transfer means disposes the extractor disk of the case of a transferred round of ammunition into said passageway defined by said extractor hooks, with said hooks entering the extractor groove of that case.

11. A gun according to claim 10 further including:

first means including:

first power transfer means for driving said first transfer means throughout each gun cycle, and second power transfer means for driving said second transfer means for a lesser interval during each gun cycle.

12. An at least partly self acting gun having a repeated cycle of operation comprising:

a housing;

a bolt having a bolt face and disposed in said housing and reciprocable along a longitudinal axis to and between a seared station and a chambered station;

first rounds transfer means disposed in said housing for receiving a train of rounds at a substantially uniform linear velocity;

second rounds transfer means disposed in said housing for transferring the leading round from said first rounds transfer means to said bolt face when said bolt is at its seared station;

drive means for said first and second rounds transfer means including:

first rotary means for rotation at a substantially uniform velocity during the entire gun cycle;

first power transfer means coupled to and between said first rotary means and said first rounds transfer means for driving said first rounds transfer means at a substantially uniform velocity during the entire gun cycle for each gun cycle;

second power transfer means coupled to and between said first rotary means and said second rounds transfer means for driving said second rounds transfer means for an interval less than a whole gun cycle during each gun cycle;

said second power transfer means including:

a power train coupling means switched by a cam follower having a switch on position and a switch off position, and a rotary cam driver driven by said first rotary means and driving said cam follower to and between said switch on and switch off positions.

13. A gun according to claim 12 further including:

a third rounds transfer means disposed in said housing for receiving an additional train of rounds at a substantially uniform linear velocity;

a fourth rounds transfer means disposed in said housing for transferring the leading round from said third rounds transfer means to said bolt face when said bolt is at its seared station; and said drive means further includes:

third power transfer means coupled to and between said first rotary means and said third rounds transfer means for driving said third rounds transfer means at a substantially uniform velocity during the entire gun cycle for each gun cycle, fourth power transfer means coupled to an between said first rotary means and said fourth rounds transfer means for driving said second rounds transfer means for an interval less than a whole gun cycle during each gun cycle, said fourth power transfer means including:

an additional power train coupling means switched by an additional cam follower having a switch on position and a switch off position; and an additional rotary cam driver by said first rotary means and driving said additional cam follower to and between said switch on and switch off positions.

14. A gun according to claim 13 further including:

selection means coupled to said first, third, second and fourth power transfer means for alternatively (1) enabling said first and second power transfer means and disabling said third and fourth power transfer means, and (2) disabling said first and second power transfer means and enabling said third and fourth power transfer means.

15. A gun according to claim 14 wherein:

said selection means includes:

means for alternatively (1) interengaging said cam follower and said cam driver and disengaging said additional cam follower and said additional cam driver, and (2) disengaging said cam follower and said cam driver and interengaging said additional cam follower and said additional cam driver.

16. An at least partly self acting gun having repeated cycles of operation and firing a train of rounds of ammunition comprising:

a housing;

a bolt having a bolt face and disposed in said housing and reciprocable along a longitudinal axis to and between a seared station and a chambered station;

said bolt face including a pair of diametrically opposed extractor hooks defining a passageway therebetween for passing the extractor disk of the case of a round of ammunition;

first transfer means disposed in said housing for receiving a first train of rounds and for withdrawing the leading round from its train;

second transfer means disposed in said housing for receiving a second train of rounds and for withdrawing the leading round from its train;

third transfer means disposed in said housing for transferring the withdrawn leading round from said first transfer means to said bolt face when said bolt is at its seared station;

fourth transfer means disposed in said housing for transferring the withdrawn leading round from said second transfer means to said bolt face when said bolt is at the seared station; and drive means having a first disposition for driving said first and third transfer means and locking said second and fourth transfer means, and a second disposition for driving said second and fourth transfer means and for locking said first and third transfer means;

said third and fourth transfer means respectively disposing the extractor disk of the case of a transferred round of ammunition into said passageway defined by said extractor hooks, with said hooks entering the extractor groove of that case;

said third and fourth transfer means respectively including:

first guide means pivoted to said housing for movement in a plane transverse to said longitudinal axis of said gun bolt;

second guide means carried by and journaled for reciprocation along said first guide means and having a pair of spaced apart arms defining a recess for receiving a round of ammunition; and crank means pivoted to said second guide means for reciprocating said second guide means upons said first guide means and thereby causing said first guide means to reciprocate upon its pivot.

17. A gun according to claim 16 wherein:

said drive means includes:

first power transfer means for driving said first transfer means throughout each gun cycle, and third power transfer means for driving said third transfer means for a lesser interval during each gun cycle.

18. A gun according to claim 16 wherein:

said drive means includes:

second power transfer means for driving said second transfer means through each gun cycle, and fourth power transfer means for driving said fourth transfer means for a lesser interval during each gun cycle.

19. A feeder mechanism for a gun having repeated cycles of operation and adapted to fire linked rounds of ammunition from a train of rounds of ammunition, the mechanism including:

a first power-transmission-drive including a succession of drivable members which succession terminates in a respective first ammunition-rounds transfer means adapted to receive the train of rounds and to withdraw the leading round from its place in the train;

a second power-transmission-drive including a succession of drivable members which succession terminates in a respective second ammunition-rounds transfer means adapted to transfer the said leading round from the first transfer means to the face of the gun's bolt after the last previous leading round has been fired, wherein the second ammunition-rounds transfer means comprises a moveable feed-arm which is forked towards one end and adapted to seat and to carry bodily the said leading round between the prongs defining the fork, and to positively position the transferred round to the face of the gun's bolt, a rotary output shaft of the second rounds-transfer-means, and submechanism intercoupling the rotary shaft and the feed-arm to impart motion to the feed-arm.

20. A feeder-mechanism as claimed in claim 19 comprising two similar feedarms and two similar submechanisms coupled to the rotary output shaft the arrangement being such that the two feedarms' geometric orientations relative to the rotary output shaft are essentially the same throughout each cycle of the gun's operation, the two feedarms being spaced apart, considered in the axial direction of the rotary output shaft, by a distance which is somewhat less than the length of the round of ammunition bodily carried by them.

21. A feeder-mechanism as claimed in claim 19 wherein each submechanism together with its feedarm constitutes an oscillating crank mechanism to provide to-and-fro-rocking motion to the feedarm.

22. A feeder-mechanism as claimed in claim 21 wherein each feedarm has a tubular main-body which overfits, and is slideable on, a rod of length greater than the length of the tubular main-body such that one end of the rod projects into the space between the feedarm's prongs and contacts the ammunition-round seated between them, the other end of the rod being mounted to a pin for pivotal movement of the rod about the pin, each oscillating crank mechanism further including a crank which is coupled towards its one end to the rotary output shaft for rotational movement in unison with the shaft and towards its other end to a pin fixed to the main tubular body for pivotal movement of the crank about the latter pin, whereby during the resultant reciprocating sliding motion of the tubular body the transferred ammunition round is positively positioned to the face of the gun's bolt.

23. A feeder-mechanism as claimed in claim 19, wherein the rotary output shaft during each cycle of the gun's operation is driven during a fraction, termed the "operating fraction", of each cycle, and is at a standstill during the remaining fraction, termed the "non-operating fraction", of each cycle.

24. A feeder-mechanism as claimed in claim 23, wherein during an operating fraction of a cycle, the rotary output shaft is driven at substantially uniform velocity, whilst the first power-transmission-drive, inclusive of its first ammunition-rounds transfer means, is driveable at substantially uniform velocity throughout the cycle, each operating cycle.

25. A feeder-mechanism as claimed in claim 23, wherein the ratio of the operating fractional cycle to the non-operating fractional cycle, is approximately 1:3.

26. A feeder mechanism for a gun having repeated cycles of operation and adapted to fire a train of rounds of ammunition, the mechanism including:

a first power-transmission-drive including a succession of drivable members which succession terminates in a respective first ammunition-rounds transfer means adapted to receive the train of sounds and to withdraw the leading round from its place in the train;

a second power-transmission-drive including a succession of drivable members which succession terminates in a respective second ammunition-rounds transfer means adapted to transfer the said leading round from the first transfer means to the face of the gun's bolt after the last previous leading round has been fired, wherein the second ammunition-rounds transfer means comprises a moveable feed-arm which is forked towards one end and adapted to seat and to carry bodily the said leading round between the prongs defining the fork, and to positively position the transferred round to the face of the gun's bolt, a rotary output shaft of the second rounds-transfer-means, and submechanism intercoupling the rotary output shaft and the feed-arm to impart motion to the feed-arm.

27. A mechanism according to claim 26 wherein:

said feed-arm is positively, non-resiliently driven by said rotary output shaft.

* * * * *

UNITED STATES PATENT OFFICE

CERTIFICATE OF CORRECTION

PATENT NO. : 4,015,511

DATED : April 5, 1977

INVENTOR(S) : Lawrence R. Folsom, John F. O'Brien, Roger E. Gaboriault, August J. Haberstroh, Ettore J. Mancuso It is certified that error appears in the above-identified patent and that said Letters Patent are hereby corrected as shown below:

Column 1, line 43, change "round" to --rounds--.

insert after "Folsom" --et al--; line 45 delete "et al".
Column 6, line 8, after "through" insert --a--; line 10, change "264" to --254--.
Claim 1, line 11 change "or" to --for--.
Claim 6, line 50, after "said" insert --first--.
Claim 13, line 39, after "driver" insert --driving--.
Claim 16, line 18, after "means and" insert --for--; line 38 change "upons" to --upon--.
Claim 19, line 11, after "rotary" insert --output--.

--feeder-mechanism--; line 68, change "sounds" to --rounds--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*